US009533778B2

(12) United States Patent
Levenstein et al.

(10) Patent No.: US 9,533,778 B2
(45) Date of Patent: Jan. 3, 2017

(54) ASEPTIC DISTRIBUTION SYSTEM METHOD USING REFILLABLE CONTAINERS

(71) Applicant: CH&I Technologies, Inc., Santa Paula, CA (US)

(72) Inventors: Lawrence M. Levenstein, Los Angeles, CA (US); Eric A. Williams, Ojai, CA (US); Robert D. Thibodeau, Oxnard, CA (US); Freeman Gosden, Santa Barbara, CA (US)

(73) Assignee: CH&I TECHNOLOGIES, INC., Santa Paula, CA (US)

( * ) Notice: Subject to any disclaimer, the term of this patent is extended or adjusted under 35 U.S.C. 154(b) by 196 days.

(21) Appl. No.: 14/470,128

(22) Filed: Aug. 27, 2014

(65) Prior Publication Data

US 2014/0366492 A1 Dec. 18, 2014

Related U.S. Application Data

(63) Continuation of application No. 13/044,213, filed on Mar. 9, 2011, now abandoned.

(60) Provisional application No. 61/312,534, filed on Mar. 10, 2010.

(51) Int. Cl.

| | |
|---|---|
| ***B65B 3/04*** | (2006.01) |
| ***G06Q 90/00*** | (2006.01) |
| ***G06Q 99/00*** | (2006.01) |
| ***G09F 15/00*** | (2006.01) |
| ***G09F 27/00*** | (2006.01) |
| ***B65B 25/00*** | (2006.01) |
| ***B65B 43/00*** | (2006.01) |
| ***B65B 55/00*** | (2006.01) |
| ***B65B 65/00*** | (2006.01) |

(52) U.S. Cl.

CPC ..... *B65B 3/04* (2013.01); *B65B 25/00* (2013.01); *B65B 43/00* (2013.01); *B65B 55/00* (2013.01); *B65B 65/003* (2013.01); *G06Q 90/00* (2013.01); *G06Q 99/00* (2013.01); *G09F 15/005* (2013.01); *G09F 15/0075* (2013.01); *G09F 27/00* (2013.01)

(58) Field of Classification Search

CPC .... G06F 15/005; G06F 15/0075; G06F 27/00; G06Q 90/00; G06Q 99/00; B65B 3/04; B65B 65/003; B65B 55/00; B65B 43/00; B65B 25/00

USPC ..... 141/1, 2, 18

See application file for complete search history.

(56) References Cited

U.S. PATENT DOCUMENTS

| | | | | |
|---|---|---|---|---|
| 3,640,430 A * | 2/1972 | Roberts | G07F 13/00 | 222/1 |
| 5,903,465 A * | 5/1999 | Brown | A45D 44/005 | 700/242 |
| 8,636,173 B2 * | 1/2014 | Bartholomew | A45D 44/005 | 141/9 |
| 9,007,588 B1 * | 4/2015 | Igarashi | G05D 11/132 | 356/402 |

(Continued)

*Primary Examiner* — Timothy L Maust

(74) *Attorney, Agent, or Firm* — Fulwider Patton LLP

(57) ABSTRACT

The present invention is a marketing and distribution method for introducing and maintaining refillable containers for personal care products such as cosmetics, creams, lotions, and sprays. The refillable container is refilled at local refill stations at stores, kiosks, vending machines, and the like, to eliminate the need for new packaging with each purchase. The method is designed to reduce waste and costs associated with product packaging by using refillable containers to dispense personal care products.

8 Claims, 5 Drawing Sheets

(56) References Cited

U.S. PATENT DOCUMENTS

| | | | | |
|---|---|---|---|---|
| 2003/0051767 | A1* | 3/2003 | Coccaro | B65D 1/02<br>141/351 |
| 2008/0105328 | A1* | 5/2008 | Desmond | A45C 3/00<br>141/2 |

* cited by examiner

ASEPTIC DISTRIBUTION SYSTEM METHOD USING REFILLABLE CONTAINERS

CROSS-REFERENCE TO RELATED APPLICATIONS

This application is a continuation of application Ser. No. 13/044,213, filed Mar. 9, 2011, which claims the benefit of priority to provisional application 61/312,534, filed on Mar. 10, 2010, which is incorporated herein by reference.

BACKGROUND

The world has experienced a movement toward more environmentally friendly product packaging, which has gained momentum recently as the world begins to appreciate the ever-growing presence of non-biodegradable waste in the landfills and areas of waste disposal. Companies have tried to explore new options for controlling the amount of waste and costs associated with containers of products purchased every day. Packaging of products, including foods, beverages, personal care products, and the like are a prime candidate for further action to protect the environment.

Personal care products, such as lotions, creams, hair care products, cosmetics, and the like have been slow to move toward a more environmentally friendly packaging. This may be because the industry is, to a large extent, packaging driven, with the commercial success of many products a direct result of the public's affection for the packaging that accompanies the product rather than the quality of the product itself. Companies that sell colognes, perfumes, eye make up, cosmetic creams, etc. may spend much more capital on the response of potential customers to their packaging than their products. As a result, cosmetics and personal care products companies have resisted the movement to more environmentally friendly packaging, leading to significant waste and a higher cost to both the manufacturer and the customer for repeated purchasing of the same packaging. The present invention is directed to methods for increasing awareness and providing such companies with an easy to introduce marketing technique and system to convert consumers to a refillable container system for personal care products.

The present invention relates generally but not exclusively to the field of materials management, and more particularly to methods designed to market refilling product containers such as (but not limited to) personal care items such as cosmetics, creams, lotions, shampoos, gels, skin care products, hair care products, and the like, which are traditionally packaged and marketed in single use disposable containers.

A hand-held refillable material transfer system may be configured to move highly viscous materials from a point of manufacture to a point of use. The material transfer system may be configured to dispense only the required amount of material without waste, which is especially important when fluids or materials are not easily handled and cannot be transmitted easily or safely from container to container without unwanted exposure. Preferably, such a material transfer system would reduce or eliminate costs and expenses attendant to using traditional disposable personal packaging as well as the waste of material associated with most existing systems. Because certain materials are sensitive to contamination of one form or another, such a material transfer system may be sealed or closed system to protect product quality and allow sampling without exposing the container to contamination. This provides an allocation of product quality to either the supplier or the user. A refillable material transfer system may further be configured to use low cost components, non-pulsating solution for dispensing and transferring thick fluids and other such materials.

SUMMARY OF THE INVENTION

The present invention includes a method of using up to five components of a refill system in a multi-level distribution and allocation chain from a manufacturer to a consumer of personal care products. For example, a special refillable container is placed either side-by-side a traditional, disposable container on the shelf in a retail location, or packaged together as a combination package (or both). The customer automatically identifies herself as she reaches for the refill container or combination package that includes incentives for the customer to choose the refill option. In the case of a distribution of a personal care product with a hand-held sealed and refillable dispenser, the product may be filled in large sealed and refillable intermediate bulk containers at the point of manufacture and the large intermediate bulk containers of personal care product are shipped to warehouses in the distribution chain. At the warehouses, the intermediate bulk containers are connected to warehouse refill stations that are used to fill refill cartridges of the personal care products. The refill cartridges may be then be delivered to retail locations, for example, department stores, shopping area kiosks, and vending machines in airports and hotels, to replenish refill stations of the personal care products. A consumer brings back to a retail location a special, refillable container that can be loaded into the refill station and filled with product, allowing the same refillable container to be used over and over again. When the customer's refill container is empty or when the customer wishes to refill the sealed and refillable container, the refill container is brought to a local refill station and loaded with product. Since the consumer is only charged for what is delivered, there is no waste of product that accompanies single use containers. Further, the repeated use of the refill container prevents environmental waste by eliminating the need for a new container every time the previous container is emptied.

DETAILED DESCRIPTION OF THE PREFERRED EMBODIMENTS

Figure 1:
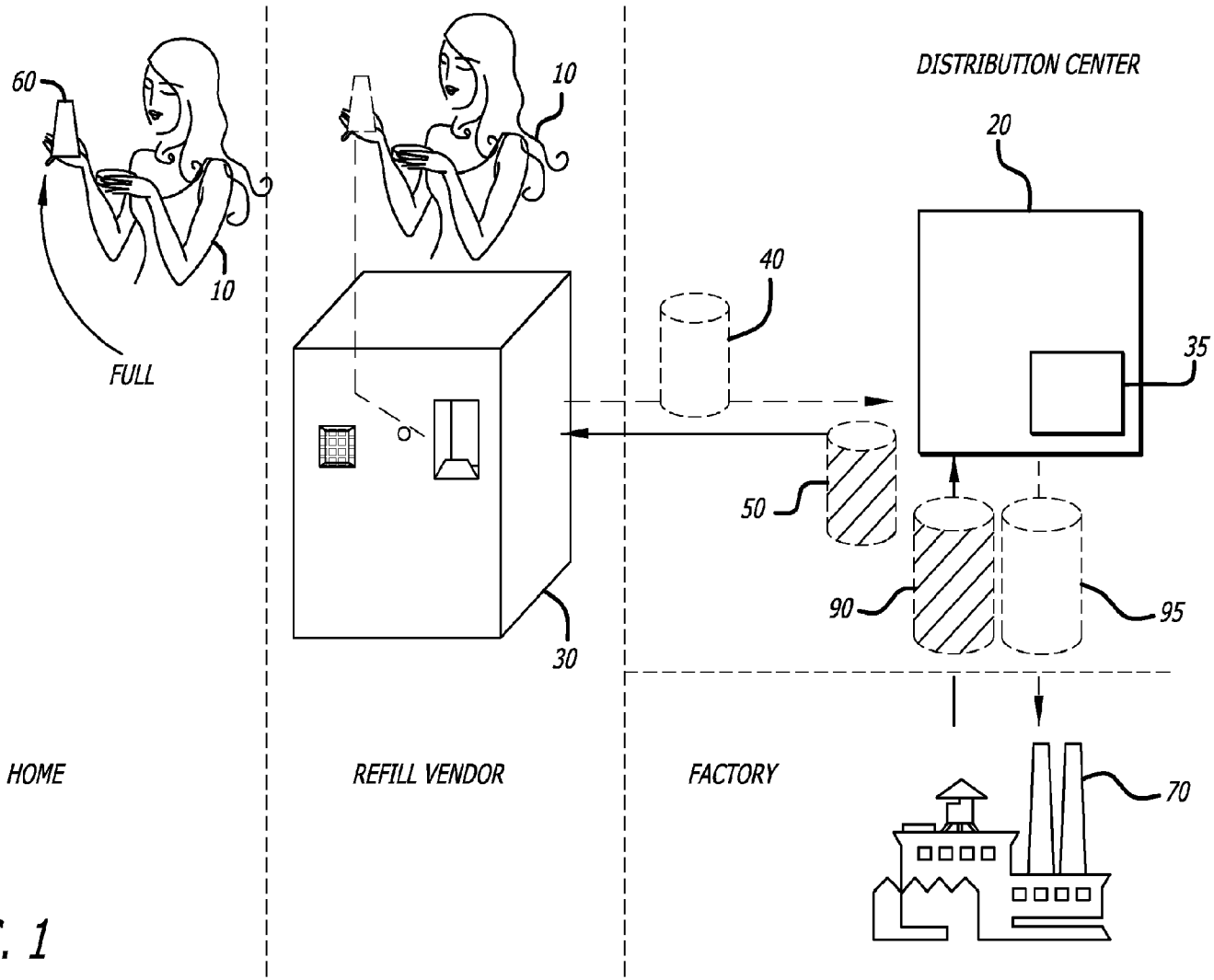
FIG. 1 is a schematic illustration of a first preferred embodiment of a distribution system.

Refill marketing can change the way that cosmetics and personal care products are marketed because it is simple, it lowers the price for consumers, it increases profits of the companies who implement it, and can provide a competitive advantage over competitors in the marketplace. The costs to implement a refill program are few, such as the cost of the refill package, depreciation costs spread over refills of refill stations and cartridges used to actuate the refill packaging, and incremental return shipping costs per refill. Compared to traditional packaging, the tables below shows that savings are easily realized.

PACKAGING, SHIPPING, HANDLING AND INVENTORY COST REDUCTION
50-ml Refill Container (2-year Retention Life)

| | Traditional | Refill Marketing |
|---|---|---|
| Package | 75% | 10% |
| Inventory | 0% | 0% |
| Royalty | | 6% |
| Logistics | | 5% |
| Support | | |
| Shipping | | |
| Package | 25% | 2% |
| Refill Cartridges | | 13% |
| Depreciation | | |
| Refill Cartridges | | 0% |
| Refill Station | | 4% |
| Warehouse Refill Station | | 0% |
| Intermediate Bulk Containers | | 0% |
| Total | 100% | 40% |
| Net Savings Per Refill | | 60% |

PACKAGING, SHIPPING, HANDLING AND INVENTORY COST REDUCTION
5-ml Sachet Refill Container (2-year Retention Life)

| | Traditional | Refill Marketing |
|---|---|---|
| Package | 83% | 2% |
| Inventory | 0% | 0% |
| Royalty | | 15% |
| Logistics | | 4% |
| Support | | |
| Shipping | | |
| Package | 17% | 1% |
| Refill Cartridges | | 9% |
| Depreciation | | |
| Refill Cartridges | | 0% |
| Refill Station | | 3% |
| Warehouse Refill Station | | 1% |
| Intermediate Bulk Containers | | 1% |
| Total | 100% | 36% |
| Net Savings Per Refill | | 64% |

Customers already have shown a preference for self-help in the name of convenience. The proliferation of automatic bank tellers, internet banking and shopping, catalogue shopping, pure water refilling, self-service gas stations, are but a few examples of how the consumer will utilize self serve methods to save time or money.

One aspect of the present invention involves the shipping of two containers to the retailer, a full traditional, disposable package and an empty refill package. The two containers can be packaged together as a combination package or displayed side-by-side on a store's shelf. The refill container label looks nearly identical to the traditional container label and it explains the benefits and promotional advantages of the refill package, along with instructions on how to refill the refillable package by either a salesperson or the customer. The consumer can be encouraged to try the refill package through point-of-purchase product offers such as free trials, discounts, and the like. The consumer may be given the option of filling the refill container at the store before check-out as part of a special, "act now" incentive coupon. Or the consumer can be offered a special incentive coupon for a free refill or the like when the refill container is returned to the store for refilling. The communication on the refill package is both instructional ("HERE'S HOW YOU DO IT.") and motivational ("IT'S EASY AS 1-2-3 AND WE PAY YOU A DOLLAR JUST TO TRY IT!"). The side-by-side shelf placement of the refill package and the traditional, disposable package, or the packaging of the two containers as a combination unit, are but two preferred modes to eliminate the need for media support.

Another aspect of the present invention involves marketing lines of refill products. This is beneficial for two reasons. First, the more products offered in a refill program, the greater the likelihood of success. It's been demonstrated many times that when the number of products in a marketing program is increased arithmetically, sales increase geometrically. Second, there are significant advantages from marketing lines of branded refill products, including but not limited to: quickly crossing the consumer value-use threshold (that is, providing sufficient perceived value for the consumer to take action), efficiently enhancing point-of-sales impact, efficiently concentrating advertising, allowing products and refill stations to be together, cross-selling, and lowering packaging costs.

The refill marketing method has many advantages that are easy and inexpensive. Significant advertising dollars to persuade the customer to try refilling can be eliminated, and there is very little cost to locate customers and educate them on the benefits of refilling their personal care packaging. The potential customers automatically identify themselves by virtue of their purchase of the refill package and the visibility of the refill packaging is in view for the customer at the moment the customer is ready to purchase product due to the side-by-side or combo positioning of the refillable and disposable containers.

The system of the present invention preferably utilizes a refill station that is friendly and easy to use, either by a salesperson or the customer. The salesperson or customer places the refill container into the refill station. The customer enters or swipes a credit card, or the salesperson enters an authorization code or other identification, and initiates the refill procedure through a button or command. If necessary to refill the refill station, a refill cartridge may be placed into the refill station, and if the refill container utilizes a removable dispensing nozzle, the nozzle can be removed and replaced on the refill container for each refill. The refill station is designed to be user friendly, with required skills including removing and replacing refill containers and/or refill cartridges, operation of controls, etc. Where removable nozzles are present, the refill station can offer replacement nozzles in a protected environment such as a plastic bag.

After the button on the refill station is pushed, the refill station takes over. In a preferred embodiment, the refill station reads an RFID chip and/or bar code on the refill container, and matches this to an RFID chip and/or bar code on the appropriate product refill cartridge, weighs the refill container, and transfers the correct amount of fluid into the refill container. Upon completion, the refill station may issue a sales check, receipt, an additional refill coupon and/or any cross-selling coupons. The refill station may be operatively connected wirelessly to a data gathering system or marketing department, where the cross-sell and/or other incentive coupons issued can be managed on an hourly, daily, or weekly basis.

FIG. 1 illustrates a first preferred distribution system according to the method of the present invention. A manufacturing facility 70 where personal products are manufactured is the starting location for the process. Ordinarily, personal products such as creams, lotions, soaps, hair care products, and the like would be packaged in disposable containers and shipped to retail outlets for purchase by a customer or to a personal care products direct marketing dealer. In the present method, a sealed and refillable intermediate bulk container 90 is filled with one product and shipped to distribution centers or warehouses 20. In a preferred embodiment, a warehouse refill station 35 is located in distribution centers and/or warehouses 20. The product(s) may be dispensed using a refillable system such as that disclosed in U.S. patent application Ser. No. 11/096,356 to Thibodeau, assigned to the assignee of the present application, the contents of which are fully incorporated herein by reference. Also see U.S. patent application Ser. No. 11/584,932 to Williams et al. entitled "Integrated Material Transfer And Dispensing System," also assigned to the assignee of the present application, and of which the contents therein are fully incorporated herein by reference.

Once the sealed and refillable intermediate bulk containers 90 are delivered to the warehouse or distribution center 20, they can be connected to a warehouse refill station 35 and can be used to fill smaller, more portable refillable and sealed refill cartridges 50. The refill cartridges 50 are then distributed to local outlets, such as malls', department stores', kiosks', hotels' and airports' dispensing machines, and the like, generally called refill stations 30. Customers 10 bring their empty personal sealed and refillable containers 60 to the refill stations 30 in order to refill the personal container 60 with product. The refillable container 60 may include one or more fluids to be dispensed concurrently at a ratable rate. When the refill station 30 is depleted, and the portable dispensing unit 40 is empty, the empty portable dispensing unit 40 is returned to the distribution center 20 and refilled or exchanged for a full dispensing unit 50. The distribution center 20 depletes the intermediate bulk containers 90 and the empty bulk containers 95 are transported back to the manufacturer for refilling.

Figure 2:
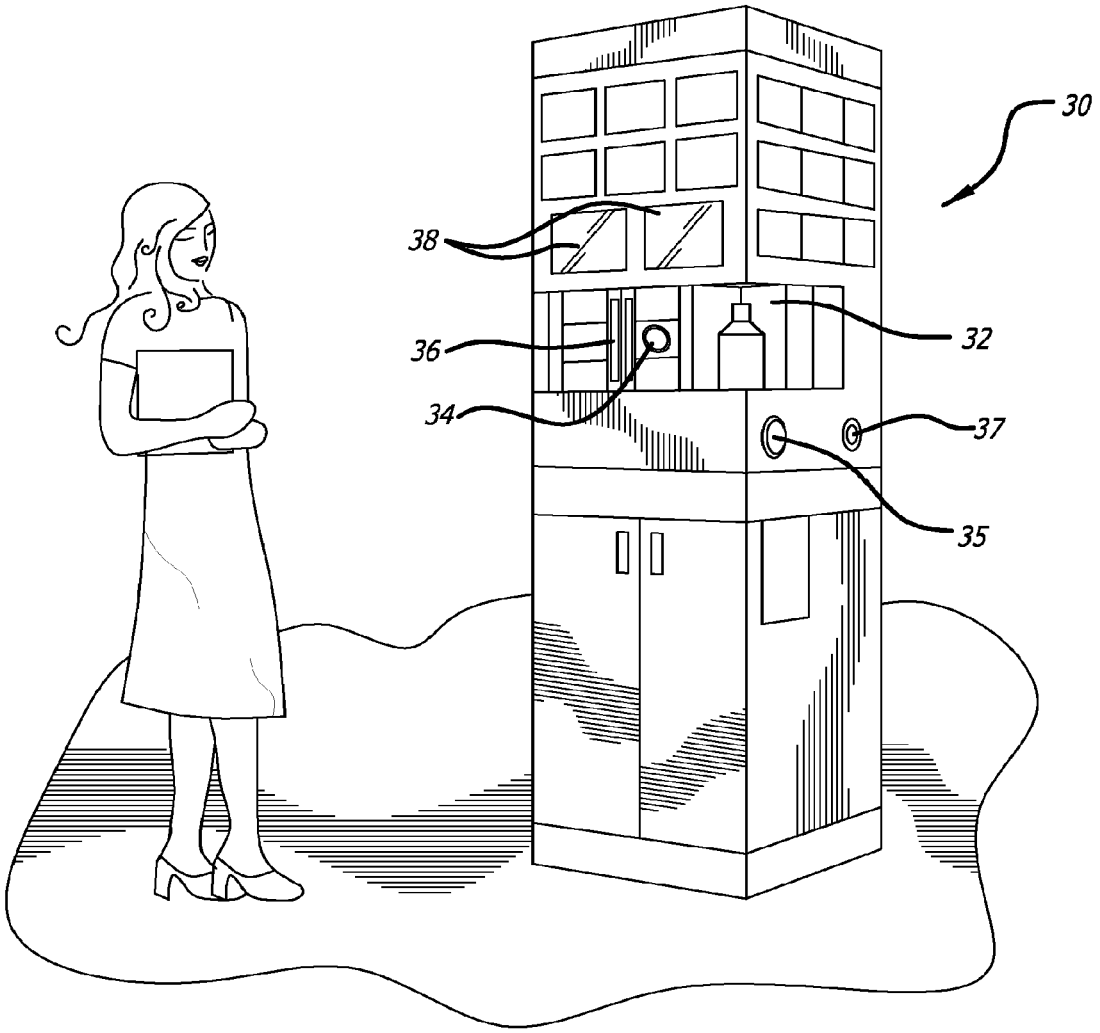
FIG. 2 is an illustration of a refill station of the present invention.

FIG. 2 illustrates a tower refill station 30, where the refillable personal containers 60 are refilled. The station may be a kiosk, vending machine, in-store display, or other commercial structure that will draw consumers' attention. In store displays can also promote refillable packaging that includes both conventional (disposable) and refillable packaging sold as a unit or side-by-side, so consumers can become accustomed to the refillable containers while purchasing their normal products and brands. The refill station 30 may be a multi-distribution kiosk where a plurality of products are dispensed. The refill station 30 may rotate to display various products or provide access to multiple dispenser openings corresponding to different products. Products may be advantageously displayed around the refill station in the refillable packaging to encourage purchase of the refillable containers, along with incentives or other promotions. The refill station 30 may include a refill cartridge storage compartment incorporated either above or below the main operation area. The refill station 30 can also be another form of incentive to try the refillable packaging. Consumers are attracted by the design and size of the display, where the size of tower refill station can be the same size as traditional towers: e.g. 2'×2'×7'. The highly-visible free-standing display may be placed in heavily trafficked areas to attract as many consumers as possible.

Another embodiment of the refill station 30 is a countertop refill station, which is typically the upper portion of the tower refill station. It is intended to sit on the sales counter and to attract the attention of near-by shoppers. The refill station 30 may include a refill chamber 32, start button 34, credit/private (salesperson) card slot 36, sales check/receipt port (not shown), nozzle dispensing port 35, nozzle disposal port 37, and interactive video screens 38 that show promotional or instructional videos to the customers. The refill station 30 is preferably located close to a beauty sales counter or gondola displaying refillable packages and traditional disposable packages side-by-side on the shelf, and prominently features the promoter's brand advertising or logo. The refill station 30 may also serve as a dramatic attraction to non-customers, whose curiosity will draw them to customers and sales people refilling their containers. The tower refill station also can eliminate the need for behind-the-counter or on-the-counter space for the product being sold. Refill stations can be designed to swivel and hold/dispense up to thirty different products or more with a single button operation. The instructional video can play on the refill station's video screens to help guide the customers on the refill system's use.

Figure 3:
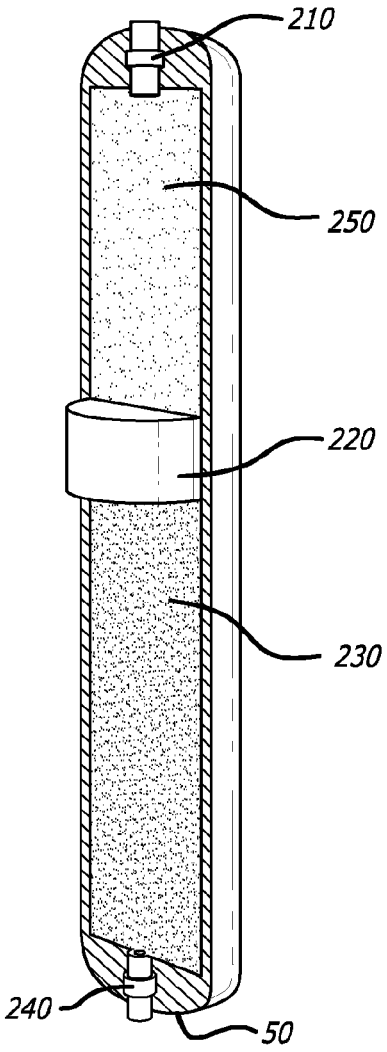
FIG. 3 is a cross-sectional view of a sealed and refillable cartridge of the present invention.

FIG. 3 illustrates a sample refillable and sealed refill cartridge 50 of the kind by which a refill station 30 is refilled. The mechanism inside the refillable and sealed refill cartridge may be functionally similar to the refillable and sealed refill container, except that it is larger. The refill cartridge 50 can be of any size. However, when the refill cartridge 50 filled with product weighs more than a reasonable amount, it may be better to refill it in place inside the refill station. This can be done using an external connection [not shown]; e.g. dry-break. In a preferred embodiment, the refillable and sealed refill cartridge 50 includes a gas port 210 at a first end and a product fill/discharge port 240 at another end. The payload 230 can be either above or below the interior force element 220. In FIG. 3 the payload 230 is below the force element 220 and a compressed gas 250 is above.

Refilling the refill cartridge 50 is highly flexible and can accommodate changes in logistical strategies. In a preferred embodiment, each separate refill cartridge for participating products can be numbered, color coded, labeled, embedded with an RFID chip, bar code, or any combination of the five. Refill cartridge sizes could include 3.9" diameter tubes by 18.6" tall, which translates into approximately sixty refills of 50 ml each, and weigh approximately seven pounds each. Of course, the dimension and weight of the cartridges will vary according to the application and the product.

Figure 4:
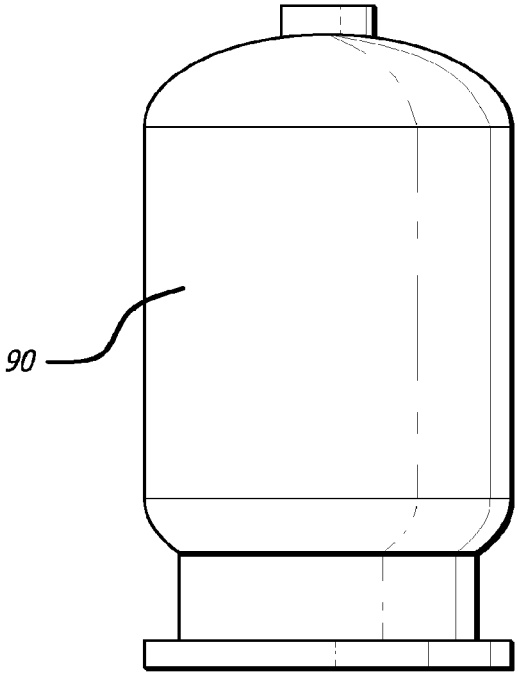
FIG. 4 is a sealed and refillable intermediate bulk container of the present invention.

FIG. 4 illustrates a sample sealed and refillable intermediate bulk container 90 (IBC) which can store a product in capacities of, for example, 7, 20, 55, 250, and 450 gallons, among others. If the 450-gallon IBC is to be self-powered, the capacity is expected to be approximately 450 gallons. If there is to be a separate power source aside from the IBC, capacity can expand to about 600 gallons.

The refill station 30 can be configured to meet alternative marketing strategies, depending upon the amount of customer involvement sought. Countertop refill stations located in department stores and specialty stores could be operated typically by a salesperson and require the least customer involvement. Next is a free-standing tower refill station at a store with salespersons available to assist the customer. Next is a kiosk refill station that may be outside of or in an unused area inside a retail store that serves as a refill and vending location. There could also be a vending machine refill station in airports, hotels, spas, and the like that would be entirely customer operated. The countertop refill station is suitable for locations where there is the greatest desire to rely on salespeople for customer service. The kiosk and vending machine refill stations are suitable for locations where there is no desire to rely on salespeople for customer service.

An additional element in the refill station's flexibility is the number of refill cartridges 50 that are operational at any moment inside the refill station 30. A single-cartridge refill station dispenses one product, and requires a refill cartridge 50 change to change products. Multiple-cartridge refill stations can dispense several products without changing refill cartridges. The more refill cartridges that are operational, generally the more products that can be transferred into personal refill containers 60 without adding or changing refill cartridges 50. Single-cartridge refill stations are suitable for point-of-sale on-the-counter applications where a salesperson is available to change refill cartridges when needed. Multiple-cartridge refill stations are better suited for kiosk, vending machine, or tower applications serviced by a salesperson or field person. A tower refill station can hold up to thirty different products and a kiosk refill station or a vending machine refill station can accommodate over 120 different products.

The tower refill stations are particularly suited for department stores, specialty stores, such as spas, salons, and smaller retailers. Countertop refill stations are applicable especially to department stores and specialty stores. Unmanned kiosk refill stations, where the customer brings her empty sealed and refillable container and operates the kiosk refilling operation, are particularly suited for mass market stores and malls. In this case, the operation would be simple like a soda dispensing machine where a customer places an empty sealed and refillable container in the proper location and presses a button, and the kiosk's automation takes care of the filling operation. Since there are multiple refill cartridges operational in a kiosk refill station (perhaps as many as 60 different products), it can refill either single-fluid or multiple-fluid refill containers. Since the kiosk needs to be refilled, it can be equipped with a processor and software adapted to wirelessly notify either a local field person, a marketing department, a factory, or other key personnel that the kiosk requires refilling soon and a refill cartridge needs replacing.

The refill system of the present invention is adaptable to hold and dispense virtually any type of fluid, such as Herschel-Bulkley fluids, Bingham plastics, Newtonian fluids, pseudoplastics, and dilatant fluids and/or any type of container, such as bottles, tubes jars, and the like. The system allows for the sealed transfer of fluids, eliminating a source of contamination when the product is transferred. With this closed system, hermetically preserved transfer can obviate the need for preservatives or other additives that prevent contamination. That is, there is no exposure of the materials and products to the atmosphere during the transfer, so the risk of contamination is minimized. The capability to provide contamination-free product transfer is important to customers who want to eliminate preservatives from their products. This can also simplify the manufacturing process, reduce supply chain complexity, and lower the cost of goods sold.

Figure 5:
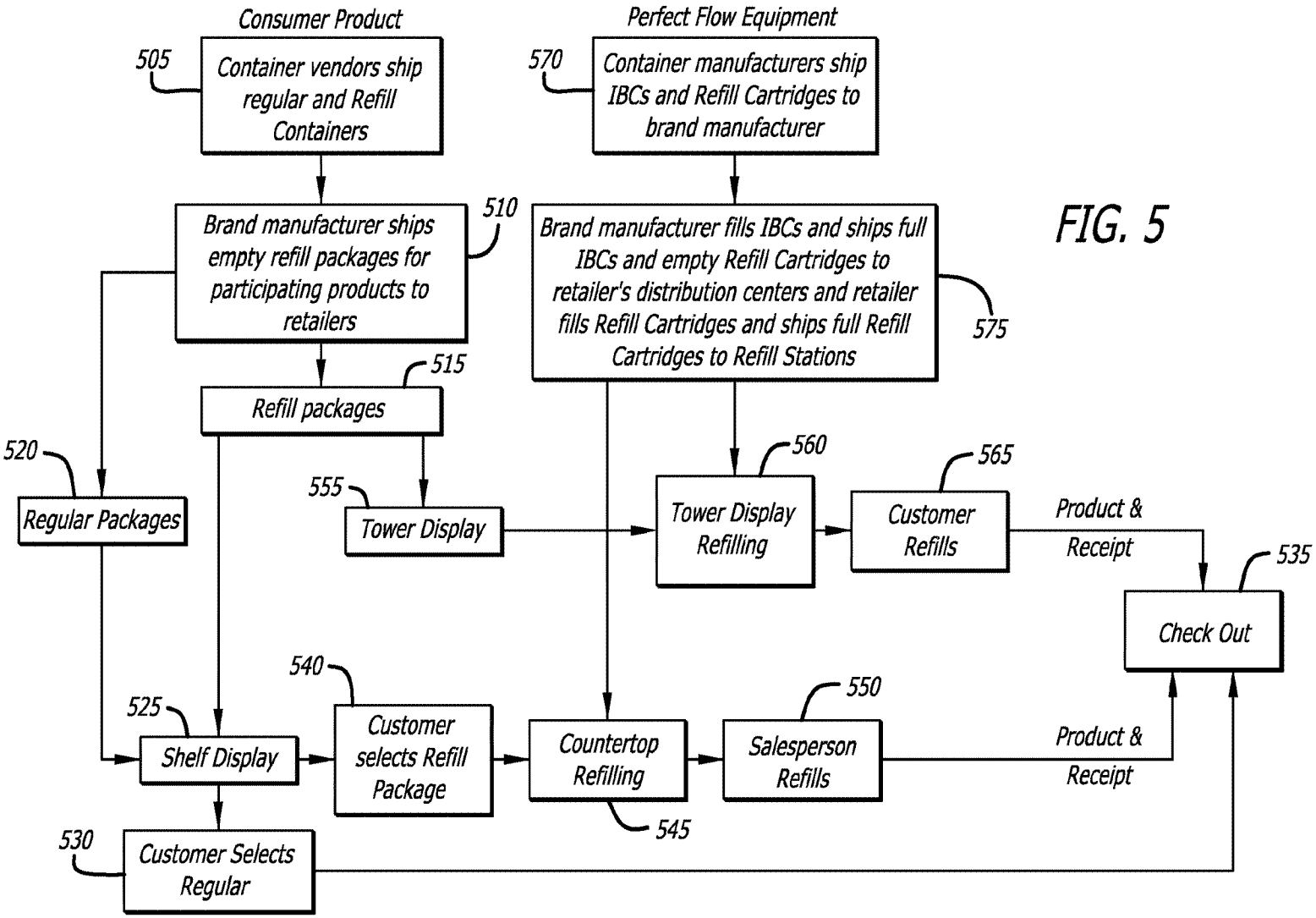
FIG. 5 is a flow chart illustrating a distribution system of the present invention.

FIG. 5 illustrates a marketing flow chart that addresses certain logistical issues with respect to a refill marketing and distribution program. The chart is divided into product inception and product refilling. In step 505, manufacturers of containers for personal care products such as soaps, creams, lotions, cosmetics, and the like ships two types of containers to a brand manufacturer (vendor), a regular disposable container and a new sealed and refillable container. In a preferred embodiment, the brand manufacturer in step 510 sends the empty refill containers 515 and regular, full disposable containers 520 to the stores where they can be displayed side-by-side on a shelf 525 for purchase of product. Alternatively, the two products can be packaged together as a "combo" unit where they are purchased together. Some customers will select the traditional packaging (step 530) and continue to the check-out counter for purchase (step 535). Other customers will take the refill package (step 540), whether purchased together or separate from the traditional container, and take the refillable package to a refill station (step 545) where a salesperson may assist in the initial refilling process (step 550). The refill station may issue a ticket or receipt that the customer takes to the check-out station (step 535) so that the customer can pay for the product.

On a return visit, the customer may bring back to the retail store her empty refill container 515 and proceeds in one preferred embodiment to the tower refill station 555 to self-refill her sealed and refillable container 515 with the desired product. Following the instructions on the refill station 555 or on a video monitor on the refill station, the customer places her refillable container 515 in the refill station (step 560) and refills her refillable container (step 565) before proceeding to check out as set forth above in step 535. Each time the customer returns with her empty refillable container, the customer can proceed directly to step 565 or step 550 and have the sealed and refillable container filled before proceeding to check out. The savings from eliminating the need for new packaging for each purchase can be passed on to the customer, as well as the elimination of waste that is helpful to the environment.

The system also provides that the distribution of the refillable and sealed refill cartridges that are used to supply the refill stations. In step 570, the manufactures of special intermediate bulk containers ("IBCs") and refill cartridges send the sealed and refillable IBCs and the refillable and sealed refill cartridges to a brand manufacturer for filling with product. The brand manufacturer in one preferred embodiment fills the IBCs and ships them and empty refill cartridges to warehouses or distribution centers where the IBCs can be used to fill refill cartridges (step 575) and deliver the filled refill cartridges to refill stations. Customers then use a refill station to refill their sealed and refillable personal containers as needed.

While the containers that are used for the sealed and refillable intermediate bulk containers 90 may be similar (except in size) to the refillable and sealed refill cartridges 50 and the refillable and sealed refill containers 60, the way in which they are used may be different. For example, the refill cartridges that restock the refill stations may be installed inside the refill station and the refill container may be placed in a refill station's refill chamber and a button is pushed to initiate the refill process, i.e., a single-flow process. It is preferable that there is an aseptic connection between the refill cartridge and the refill container that prevents exposure to the atmosphere and reduces the opportunity for contamination. Conversely, at the distribution center or warehouse where the refill cartridges are refilled, this is preferably conducted using a batch-flow process. Refill cartridges are placed on or in a feeder (conveyor belt or hopper) of the warehouse refill station 35, and there may be a cleaning cycle such as flash infrared that precedes the filling operation. There will also preferably be an aseptic connection between the IBCs and the refill cartridges.

When the customer approaches the refill station to resupply its refillable container, the refill station may also provide some features to facilitate the process or add personalization to the product that may help to attract return visits and additional customers. For example, a refill station may include a multiple-unit sealed and refillable fragrance cartridge pack that allows a customer to add a personal or desired fragrance to the product. The refill station may also provide a multiple-unit sealed and refillable encapsulation pack with micro encapsulations so the customer can modify the product to achieve desired product characteristics, for example viscosity, or color, swirls, and other visual appearances, SPF, and the like.

The refill station may also include a customer recognition system that identifies the customer and pre-selects that customer's favorite options and settings. The identification can be a user name and password, a bar code, RFID chip, cell phone id, or other mode by which a customer can be reliably and privately identified. This recognition could lead to target marketing as well, as the refill station could issue a coupon or promotional materials based on the customer's purchasing habits. The refill station could also communicate with a customer's refillable container, alerting the customer that a product is due for refilling and of possible specials or promotions involving that product. This would involve supplying the refillable container with wireless communication means that could be used to send messages or signals between the refill station and the refillable container.

By using a kiosk refill station or vending machine refill station, the opportunity to vend personal care products can expand to almost anywhere—airports, malls, strip centers—general or dedicated. The brand manufacturer benefits by up to a sixty percent reduction in packaging and transportation costs with a return on investment of up to forty-four percent. It also leads to increased sales, pricing flexibility, and creating a new channels of distribution. This leads to an increase in a brand manufacturer's profits, improved customer relations, increases in new customers, improved brand loyalty and recognition, and an increased sustainability index score.

For products in the refill program, a vendor will ship the same fluid volume and reduce the number of consumer packages shipped by a factor of up to 60 or more. Savings from refill marketing are estimated to be up to 60% reduction in packaging related costs, where such savings include anticipated reductions in transportation costs and inventory costs but not savings from eliminating preservatives. Other benefits to the vendor/brand manufacturer include reduced shipping on consumer packaging (up to 98%), reduced inventory costs for refill products (up to 6%), and compliance with new environmental regulations, laws, and preferential treatment by selected retailers.

Refill marketing is shrink proof and enjoys minimal advertising costs. Refill marketing is theft resistant because access to product in the refill station is only by either credit card or private (salesperson) card, or both. There is also reduced advertising costs because the vast majority of customers are repeat, loyal customers that come back to their favorite retailers to repurchase their products. They automatically identify themselves as they reach for the refill package next to the recognizable traditional package and are presented with an empty refill container showing (1) how much it will save them, (2) complete self-filling instructions, and (3) savings coupon(s) motivating the customer to refill and/or cross-sell other products.

Figure 6:
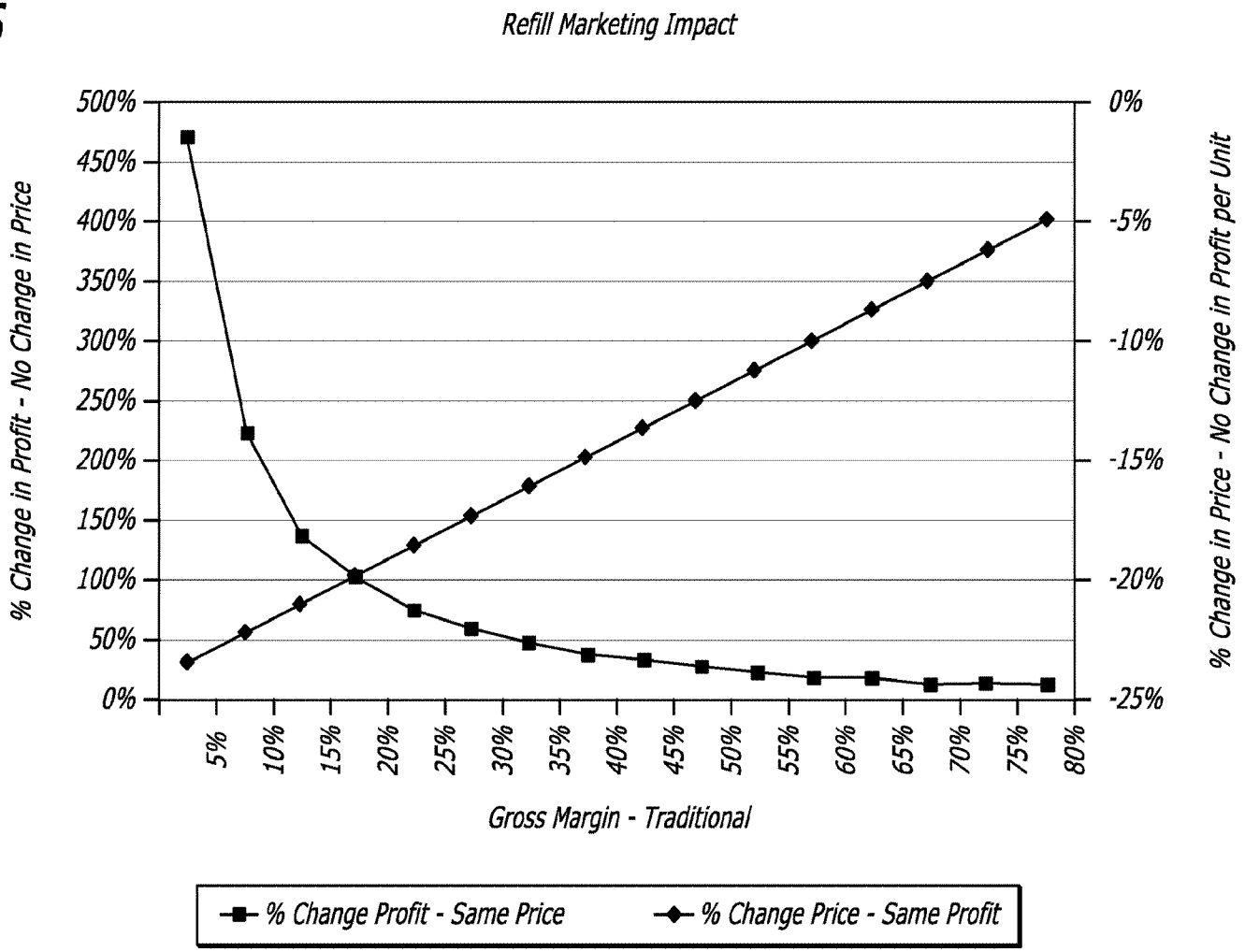
FIG. 6 is a graph showing percentage change in profit versus gross margin for refill marketing.

Since refill marketing lowers packaging related costs up to 60%, it can create certain strategic options. The first option includes keeping price constant and increasing profit per unit. The second option includes keeping the same profit per unit and increasing sales. In light of the price elasticity in most fluid products, in particular cosmetics, lower prices will likely generate higher sales. Estimates value the increase in gross profits at up to 70% when maintaining the selling price and an increase of up to 20% in sales by maintaining the same profit per unit (where packaging costs are fifty percent of the costs of goods sold and gross margin is twenty five percent). FIG. 6 illustrates a graph of gross margin and percent of change in profits where there is no change in price. The graph indicates that the lower the gross margin, the greater the percentage increase in gross profit for no change in sale price. In addition, the lower the gross margin, the greater the percentage reduction in price for the same profit per unit.

The refill stations (a) provide the opportunity for cross selling of other products outside the refill program at a key time for the customer—at the time of maximum interest before reaching the checkout counter, and (b) attract non-brand prospects with display and potential customers viewing other customers conducting the refilling operation. They also provide a location for point-of-sale advertising. It also eliminates competition for mail order competitors who cannot participate in the refill program. Also, where gross profit is maintained, a brand manufacturer's pricing may be low enough to effectively compete with private-label brands.

Since during the refill process the customer is a captive audience, the video display on the refill station can promote other products. Since a marketing effort can be connected wirelessly to refill stations, cross-selling promotions can be provided to the customer at any time of day, anywhere, and they can be adjusted on any periodic basis desired. Embedded codes can trigger data for sales slips and coupons. Upscale refill containers can be advertised as gifts.

The refill system provides high flexibility in the type of products dispensed. The refill system enhances fluid formulation options. In addition to possibly eliminating the constraint of adding preservatives and being able to accommodate both rheopectic and thixotropic fluids, it has a very high tolerance for crushable fillers, large encapsulations, and large particulates like ground minerals. The refill system's low-shear fluid delivery accommodates both shear-thickening and shear-thinning fluids. The refillable and sealed refill system is closed and provides greater control of fluid initiators, moisture-sensitive fluids, and air-sensitive fluids. The highest efficiency achieved to date is 12,000,000 centipoise for five gallons per minute, ¾" opening, 15 PSIG.

Not only does the consumer benefit from lower prices, but also the consumer only pays for the product that he or she uses. Recall that the refill station uses the embedded codes in the refill container to specify the maximum full weight of a given refill container with a specific fluid. It then subtracts the refill container's weight from this pre-specified weight and transfers the correct amount of product. Thus, the consumer does not waste product in the container and only pays for the amount of product needed to refill the container.

Major retailers are mandating that their vendors enhance their sustainability because the process toward sustainable production drives out waste. Driving out waste lowers manufacturing costs and, as a result, lower prices to such mandating retailers. This may have started with retailers with a major market share such as Walmart, but it now appears to be migrating to other major retailers. Consequently, sustainability in the mass market is rapidly becoming a major strategic competitive requirement. With the refill system, a vendor can not only enhance the sustainability of its production, but can increase profits doing so.

Sustainability in the present context relates to (1) sustainable packaging, (2) reducing product waste up to 98%, and (3) reducing carbon footprint up to 33%. Assuming a traditional package is purchased once every 90 days, then 1 refill container could replace up to 60 disposable containers. This also assumes that the refill containers have a useful life of 5 years; an average suggested by the Refillable Packaging Association. That said, there are refillable packages that have been in the field more than 20 years and whose useful life is still unknown since they continue in operation.

A primary result of the refill system is the reduction in litter, emissions, packaging waste, reduced carbon footprint, and enhanced sustainability index. Reduced emissions can come from a variety of sources: since refill marketing can provide up to a 98% reduction in packages shipped, therefore, refill marketing will lead to fewer truck shipments and lower truck emissions. Reducing the number of containers required to sell a given volume of product by up to 98% will lead to lower consumption of hydrocarbons required to manufacture such containers. Such lower consumption of hydrocarbons will lead to lower emissions. Such reduction in the number of containers also can provide up to a 98% reduction in the demand for packaging material attendant to such containers—particularly excess packaging material required to achieve a given facing on the shelf. Such reduction in packaging will lead to lower emissions.

The present invention benefits from very cost effective test marketing. The least expensive and most effective test marketing is test marketing that can be conducted anywhere and include any group of stores. Based on the suggested introduction plan for refill marketing, there is significant flexibility in how a vendor may want to test, such as by store, city, region, promotional offers, and the like. While testing of the refill marketing concept is highly flexible and inexpensive, it is also accurate since it is based on sales. So test marketing for refill marketing is inexpensive, flexible, and accurate.

In addition to the higher traffic generated by the unique refill station, the retailer derives a number of significant benefits. It has been estimated that the presence of the refill station may increase cash flow up to 28% for participating products. Other benefits include reduced restocking costs with savings up to 80% by restocking, for example, one 3-Liter refill cartridge for 60 50-ml packages or one 4.5-Liter refill cartridge for 900 5-ml sachets. The refill station can also result in increased selling space up to 30%, and increased sales from consumer incentives to purchase the refill products. There is also a significant benefit to reduced shrink because access to product is only by payment, making theft much more difficult. There is also the opportunity for increased asset utilization by expanding the amount of selling space through placement of refill stations in unused areas of the store.

The present invention should not be considered to be limited by any of the foregoing examples, which are intended to be illustrative only. Rather, the scope of the invention is properly measured by the appended claims, using the words therein as they would normally be understood using their common and every day meanings.

We claim:

1. An environmentally friendly distribution method for distributing personal care products, comprising:

manufacturing a personal care product at a point of manufacture;

aseptically transferring the personal care product at the point of manufacture to a reusable, refillable intermediate bulk container and delivering the reusable, refillable intermediate bulk container to a distribution center;

aseptically and hermetically transferring the personal care product at the distribution center from the reusable, refillable intermediate bulk container to a reusable, refillable cartridge and delivering the reusable, refillable cartridge to a refill station;

returning the refillable intermediate bulk container to the point of manufacture for refilling;

aseptically and hermetically transferring the personal care product at the refill station from the reusable, refillable cartridge to a reusable, refillable personal container;

returning the reusable, refillable cartridge to the distribution center for refilling; and returning the reusable, refillable personal container to the refill station for refilling.

2. The environmentally friendly distribution method of claim 1, wherein the personal care product is a dilatant fluid.

3. The environmentally friendly distribution method of claim 2, wherein the refill station automatically determines an amount of available space in the reusable, refillable personal container, and automatically delivers only an amount of personal care product to the reusable, refillable personal container to use the available space.

4. The environmentally friendly distribution method of claim 2, wherein the refill station includes a customer identification system, and stores and recalls customer information associated with an identified customer.

5. The environmentally friendly distribution method of claim 2, wherein the refill station can automatically, wirelessly communicate with the distribution center when the refill station needs a replacement reusable, refillable cartridge.

6. The environmentally friendly distribution method of claim 2, wherein the personal care product is transferred from the point of manufacture to the reusable, refillable personal container without substantially exposing the personal care product to air.

7. The environmentally friendly distribution method of claim 2, wherein the refill station dispenses a plurality of personal care products.

8. An environmentally friendly distribution method for a distributing dilatant fluid to a consumer, comprising:

manufacturing the dilatant fluid at a point of manufacture;

aseptically transferring the dilatant fluid at the point of manufacture to a reusable, refillable intermediate bulk container and delivering the reusable, refillable intermediate bulk container to a distribution center;

aseptically and hermetically transferring the dilatant fluid at the distribution center from the reusable, refillable intermediate bulk container to a reusable, refillable cartridge and delivering the reusable, refillable cartridge to a refill station;

returning the refillable intermediate bulk container to the point of manufacture for refilling;

aseptically and hermetically transferring the dilatant fluid at the refill station from the reusable, refillable cartridge to a reusable, refillable personal container;

returning the reusable, refillable cartridge to the distribution center for refilling; and returning the reusable, refillable personal container to the refill station for refilling.

* * * * *